US008459274B2

(12) United States Patent
Ducoffre

(10) Patent No.: US 8,459,274 B2
(45) Date of Patent: Jun. 11, 2013

(54) ADJUSTABLE DEVICE FOR PROTECTING THE EDGE OF THE FINGERNAIL AND POSITIONING A STENCIL ON THE NAIL

(76) Inventor: Jean-Pierre Ducoffre, Biarritz (FR)

( * ) Notice: Subject to any disclaimer, the term of this patent is extended or adjusted under 35 U.S.C. 154(b) by 379 days.

(21) Appl. No.: 12/677,563

(22) PCT Filed: Sep. 12, 2008

(86) PCT No.: PCT/FR2008/001285

§ 371 (c)(1),
(2), (4) Date: Jun. 19, 2010

(87) PCT Pub. No.: WO2009/071757

PCT Pub. Date: Jun. 11, 2009

(65) Prior Publication Data

US 2011/0168197 A1 Jul. 14, 2011

(30) Foreign Application Priority Data

Sep. 14, 2007 (FR) ..... 07 06458

(51) Int. Cl.

| | |
|---|---|
| ***A45D 29/00*** | (2006.01) |
| ***A45D 29/118*** | (2006.01) |
| ***A45D 40/30*** | (2006.01) |
| ***B26B 13/22*** | (2006.01) |
| ***A41F 1/00*** | (2006.01) |
| ***A41F 1/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |

(52) U.S. Cl.
USPC ..... 132/285; 132/73.5; 132/73; 132/319; 24/507

(58) Field of Classification Search
USPC ..... 132/285, 200, 217, 231, 234, 277, 132/73, 73.5, 333, 319, 320; 2/21, 163; 24/509, 24/510, 511, 513, 516, 507, 521, 539; 294/8.5, 294/25; 602/22, 30, 31; 101/127.1, 128
See application file for complete search history.

(56) References Cited

U.S. PATENT DOCUMENTS

| | | | | |
|---|---|---|---|---|
| 796,389 | A * | 8/1905 | Wright | 132/75.5 |
| 2,055,357 | A * | 9/1936 | Konecke | 132/285 |

(Continued)

FOREIGN PATENT DOCUMENTS

| | | | |
|---|---|---|---|
| BE | 716 700 | A | 12/1968 |
| WO | WO 95/23537 | A | 9/1995 |

OTHER PUBLICATIONS

International Search Report, May 15, 2009, from International Phase of the instant application.

*Primary Examiner* — Vanitha Elgart
(74) *Attorney, Agent, or Firm* — Jackson Patent Law Office

(57) ABSTRACT

Disclosed is an adjustable device enabling protection of the edge of a nail and positioning of a stencil on the nail. The adjustable device comprises a first sleeve on a first bar; a second bar attached such that the second bar is non-parallel to the first bar; a second sleeve on a second bar; and a cover attached to the first and second sleeves. The cover is configured to enable a stencil to be positioned under the cover, and configured such that adjustment of the cover is effectuated by sliding of the sleeves in a direction where the first and second bars diverge from each other, causing the cover to flatten and causing the sleeves to rotate, or by sliding of the sleeves in a direction where the first and second bars converge toward each other.

12 Claims, 3 Drawing Sheets

U.S. PATENT DOCUMENTS

| | | | | | |
|---|---|---|---|---|---|
| 2,180,519 | A | * | 11/1939 | Hamilton et al. | 132/285 |
| 2,209,167 | A | | 7/1940 | McKinney | |
| 2,262,977 | A | * | 11/1941 | Vasil | 132/285 |
| 2,287,062 | A | * | 6/1942 | Powers et al. | 132/285 |
| 2,454,004 | A | | 11/1948 | Pettyjohn | |
| 2,485,384 | A | * | 10/1949 | Klein | 132/285 |
| 2,514,975 | A | | 7/1950 | Smidl | |
| 2,580,893 | A | * | 1/1952 | Dee | 132/285 |
| 2,592,293 | A | * | 4/1952 | Knepper et al. | 132/285 |
| 2,654,375 | A | | 10/1953 | Frank et al. | |
| 2,979,060 | A | * | 4/1961 | Reiner | 132/277 |
| 3,141,218 | A | * | 7/1964 | Eckman | 24/511 |
| 3,603,321 | A | * | 9/1971 | Viltrakis | 132/277 |
| 3,972,325 | A | * | 8/1976 | Bluestone | 128/846 |
| 3,983,887 | A | * | 10/1976 | Chan | 132/277 |
| 4,172,461 | A | * | 10/1979 | Pangburn | 132/73 |
| 4,605,024 | A | * | 8/1986 | Tremblay | 132/320 |
| 5,435,329 | A | * | 7/1995 | Heck et al. | 132/200 |
| 5,924,428 | A | * | 7/1999 | Song | 132/285 |
| 6,012,461 | A | * | 1/2000 | McKew | 132/73 |
| 6,357,451 | B1 | * | 3/2002 | Carter | 132/200 |
| 2002/0059940 | A1 | * | 5/2002 | Cain-Kozma | 132/73 |
| 2010/0170528 | A1 | * | 7/2010 | Espinosa et al. | 132/285 |
| 2011/0220137 | A1 | * | 9/2011 | Still | 132/73 |
| 2011/0303237 | A1 | * | 12/2011 | Lieu | 132/285 |

* cited by examiner

ADJUSTABLE DEVICE FOR PROTECTING THE EDGE OF THE FINGERNAIL AND POSITIONING A STENCIL ON THE NAIL

TECHNICAL FIELD

The present invention relates to an adjustable device positioned on any finger is such a way as to protect the edge of the nail and to be able to cover the nail with a stencil. This device enables an operation on the nail such as the application of a varnish, cleanly, quickly, fully or partially according to decorative designs on stencil.

PRIOR ART

The protection of the edge the nail traditionally consists essentially of wiping the smudges or the precaution of not "overrunning" the nail, that is to say the skill and the patience of the person, in order to obtain a nice result on both hands, not eliminating the risk of smudges. The decoration of the nail is traditionally effectuated by adhesive techniques between the applications of varnish and does not eliminate the risk of smudging or allowed the free artistic expression of the person with her brush, which is limited to the capacities of each.

Sometimes the protection of the edge of the nail and the decoration of the nail is entrusted to a third person or a professional enabling an application without the need to be skilful and patient oneself but involves a dependence on others and does not always eliminate the risk of smudging.

The device according to the invention enables remediation of these drawbacks. There exist registrations for adjustable devices with different modes of operation and structures. The closest prior art registered as U.S. Pat. No. 2,454,004 of N. D. John Petty of 16 Nov. 1948, differs from the present invention by the manner of making the adjustment.

SUMMARY OF THE INVENTION

A clamp constituted by two jaws, upper and lower, articulated around a shaft. A torsion spring surrounding the shaft, and connected at each of the ends of the clamp, maintains the jaws closed, which rest against each other on their stops. The upper jaw in the shape of two bars (or rails), that gradually diverge from each other, enable the displacement of a cover, a flexible plate designed to protect the edge of the nail. This cover, slightly curved upward, comes to be lodged between the bars. It is attached to sleeves sliding on the bars. Driven by the sleeves, its position is adjustable: it curves or flattens according to the separation of the bars driving the rotation of the sleeves as as they slide progressively. The lower jaw is in the shape of a railing. A stencil, thin and flexible plate, is designed to be lodged under the cover.

A pressure with two fingers of a hand on the ends of the clamp enables the user to open the jaws. Two fingers of the other hand enable her to adjust the cover under which the user then places a possible stencil then the finger corresponding to the selected adjustment. The user recloses the clamp on the finger by releasing the pressure that she had made to open. The two jaws exert a pressure on the finger covering its upper end and allowing appearance of the nail, which can be covered with a stencil.

According to particular implementation modes:

- A layer of foam can come to line the cover on the surface pressing on the finger
- The sleeves, at minimum one per bar, can be open on one side in order to remove them from their shaft (bars) and thus remove the cover and change it.

- The torsion spring and shaft can be replaced by a curved blade joining its ends (leaf spring).
- Reference marks can be present on at least one of the bars.
- The two bars of the upper jaw can be interconnected.
- The upper jaw can be slightly curved
- The lower jaw can be narrower than the upper jaw and can curve slightly downward.

BRIEF DESCRIPTION OF DRAWINGS

The accompanying drawings illustrate the invention.

BEST MODE OF CARRYING OUT THE INVENTION

Figure 1:
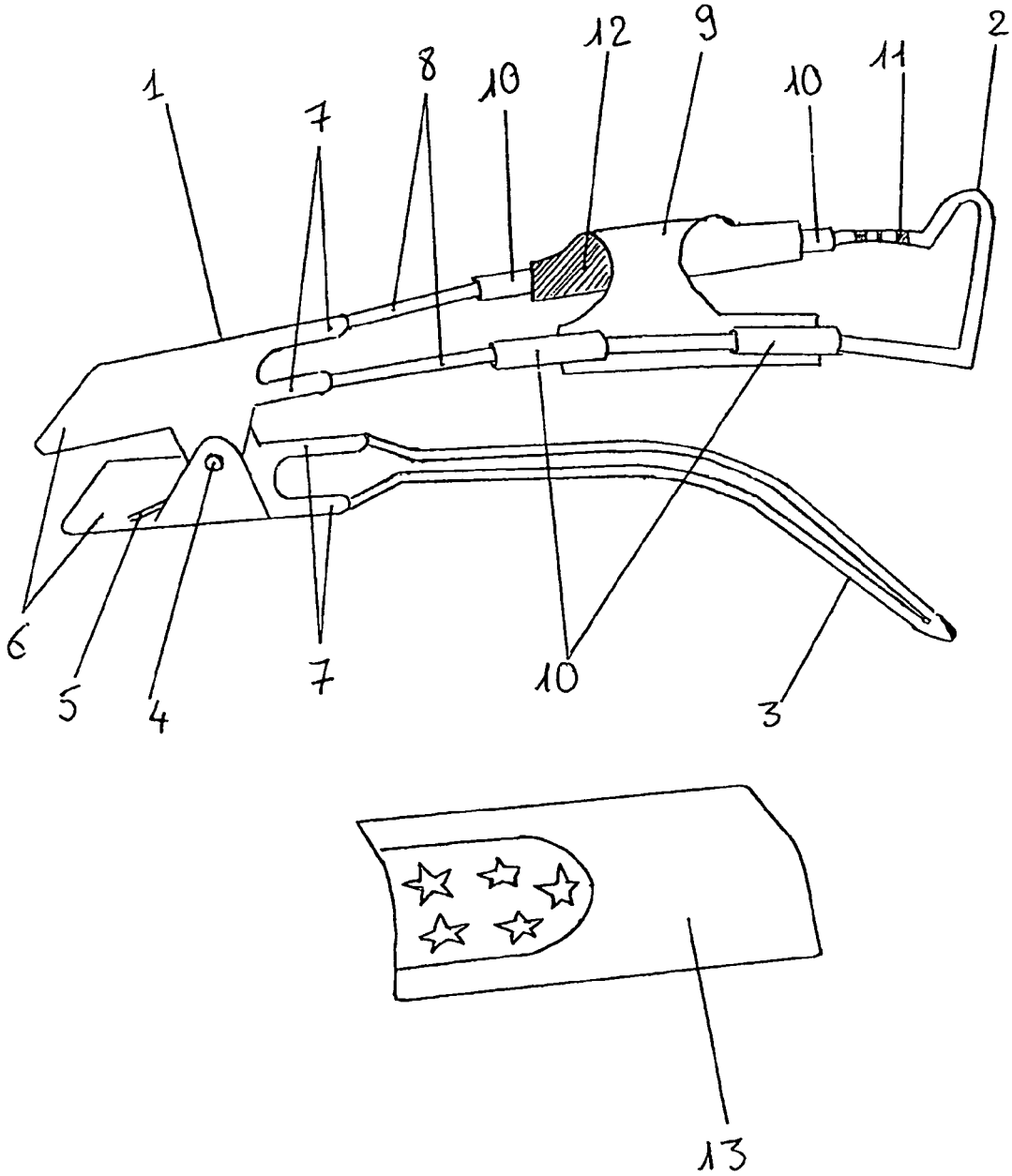
FIG. 1 shows the device of the invention in open position

Referring to the drawings, in the implementation from according to FIG. 1, the device comprises a clamp (1), constituted by an upper jaw (2) and a lower jaw (3) articulated around a shaft (4). A torsion spring (5) surrounding the shaft and connected to each of the ends (6) of the clamp (1) enables maintenance of the jaws (2, 3) closed, which rest against each other through stops (7).

The upper jaw (2), in the shape of two bars (8) that gradually diverge from each other, enables the displacement of a cover (9), flexible plate designed in order to protect the edge of the nail. This cover (9), slightly curved upward comes to be lodged between the bars (8). It is attached to sleeves (10) sliding on the bars (8). Driven by the sleeves (10), its position is adjustable according to reference marks (11) on at least one of the bars (8). It curves or flattens according to the separation of the bars (8) driving the rotation of the sleeves (10) as they progressively slide. A layer of Foam (12) comes to line the cover (9) on its bottom. The lower jaw (3) in the shape of a railing curves progressively downward. A stencil (13), thin and flexible plate perforated by decorative designs, is designed in order to be attached and lodged under the cover (9).

A pressure with two fingers of a hand on the ends (6) of the clamp (1) enables the user to open the jaws (2, 3). Two fingers of the other hand enable her to adjust the cover (9) under which subsequently she places a possible a stencil (13), then the finger corresponding to the selected setting. The user recloses the clamp (1) on the finger by releasing the pressure that she had made to open it. The two jaws (2, 3) exert a pressure and thus maintain the cover (9) pressed on the finger masking its upper end and allowing appearance of the nail, which can be covered with a stencil (13).

The stencil (13), thin and flexible plate pierced according to the desired pattern and having a surface with pattern superimposed at the location reserved for the nail by the cover (9) with a length enabling coverage of a long nail and an adhesive surface in order to be attached and thus lodged under the cover enabling appearance of the pattern at the location reserved for the nail. It is sufficiently flexible and thin in order to fit the shape of the nail and not to leave space where a varnish for example could leach.

The lower jaw provides the inclination of the finger according to its placement at the upper jaw (2). The bigger the finger, the more it is inclined.

The foam, buffer role, has the purpose of fitting the shape of the finger, that is to say, to adapt to different fingers, in order to avoid drips and leaks.

Figure 2:
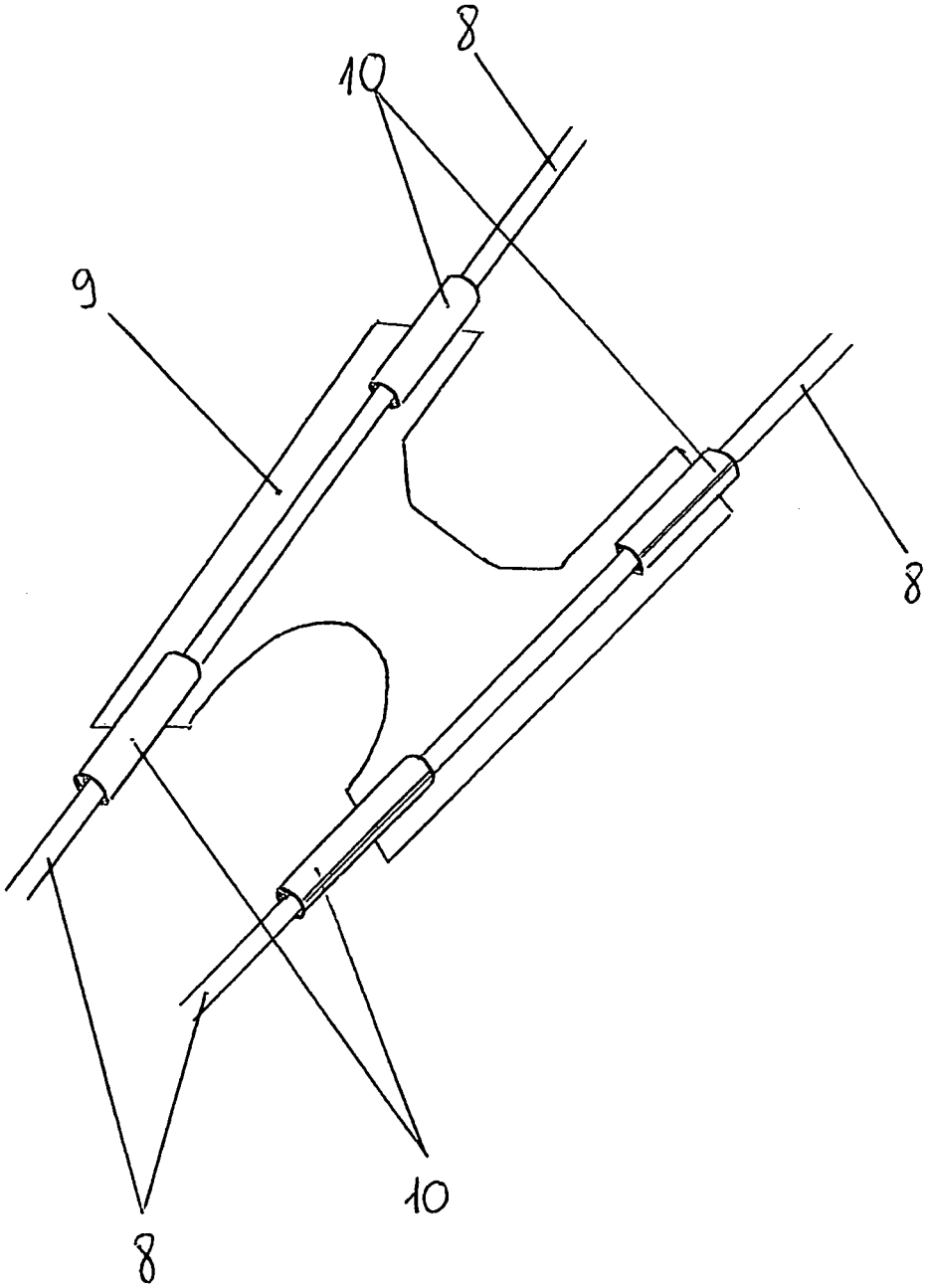
FIG. 2 shows the cover mechanism

In the implementation form shown in FIG. 2, the user slides the sleeves (10) on the bars (8) in order to move the cover (9). In the direction where the bars (8) diverge from each other, the cover (9) flattens without breaking because the sleeves (10) pivot automatically, it keeps a certain curvature. In the inverse in the direction where the bars (8) converge, the cover (9) curves naturally via the rotation of the sleeves (10).

The sleeves, of rubbery material, these tubes fit to the bars (8). They are sufficiently tight to keep the desired position and flexible so that they can be displaced without forcing; it suffices to slide them with two fingers. Note: Provide sleeves sufficiently long in front in order to protect the bars (8) during a nail varnish, for example. The sleeves (10) are slit and enable the removal and replacement of the cover.

Figure 3:
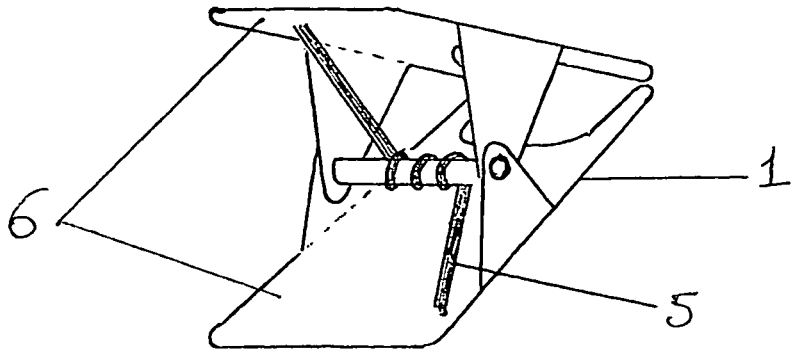
FIG. 3 emphasizes the torsion spring

In the implementation form shown in FIG. 3 the torsion spring (5) works by variation of the angular separation of its branches under the action of a torque (ends (6) of the clamp (1)).

Figure 4:
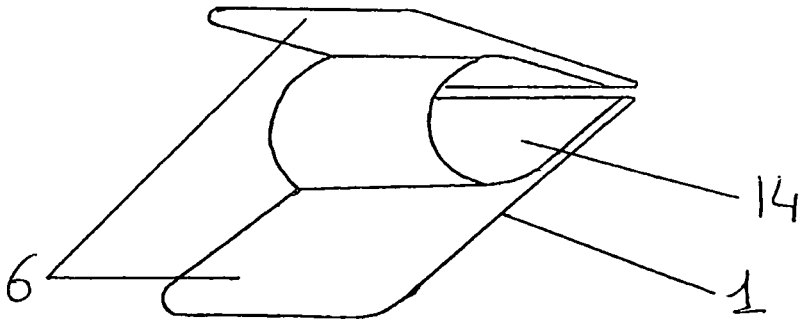
FIG. 4 emphasizes the leaf spring

In the implementation form shown in FIG. 4 the leaf spring (14) is a curved blade on which rests the ends (6) of the clamp (1) and providing the initial closed position. It replaces the shaft (4), the torsion spring (5) and, if need be, the stops (7) that existed in FIG. 1.

By way of example and non limiting:

The clamp will have a length of 12 cm.

The shaft will be situated 1.5 cm from the ends.

The stop is made 1 cm after the shaft.

The lower jaw or railing of 10 cm (bended gradually downward), in closed position it lightly lodged in the upper jaw, which is wider.

The upper jaw is constituted by two slightly curved bars of 9 cm diverging from each other gradually and then rejoining by going up by 2 cm (bridge connecting the two bars and allowing the passage of the finger in the extension of the bars).

The separation of the bars starts for example from 1.2 cm being able to accommodate the thinnest finger and to finish at 2.2 cm being able to accommodate the largest finger.

The cover has the shape of an H whose part designed to delineate the edge of the nail is based on the middle finger. The spring blade may be made of laminated metal.

The stencil can be synthetic material, nylon, plastic, etc. . . .

The device according to the invention is particularly designed for an operation on the nail such as varnishing and decoration.

The invention claimed is:

1. An adjustable device enabling protection of the edge of a nail and positioning of a stencil on the nail, the adjustable device comprising:

a spring;

a clamp constituted by a lower jaw and an upper jaw, each jaw being articulated, enabling closure of the jaws by force from the spring, and enabling separation of the jaws by a prying pressure on the ends of the jaws and thus enabling positioning of a selected finger between the jaws, the selected finger having a nail;

a first bar attached to the upper jaw;

a first sleeve on the first bar;

a second bar attached to the upper jaw, such that the second bar is non-parallel to the first bar;

a second sleeve on the second bar; and a cover attached to the first and second sleeves, the cover being configured to enable a stencil to be positioned under the cover, wherein the first bar, the first sleeve, the second bar, the second sleeve, and the cover are configured such that adjustment of the cover is effectuated by sliding of the sleeves in a direction where the first and second bars diverge from each other, causing the cover to flatten and causing the sleeves to rotate, or by sliding of the sleeves in a direction where the first and second bars converge toward each other, causing the cover to curve and causing the sleeves to rotate, and wherein when the jaws reclose, the cover comes to cover the end of the selected finger, allowing appearance of the nail and coverage of the nail with the stencil positioned under the cover.

2. An adjustable device according to claim 1 characterized in that a layer of foam lines the cover on its lower surface, and it presses on the finger.

3. An adjustable device according to claim 1 characterized in that the sleeves are opened by a slit across the length.

4. An adjustable device according to claim 1 characterized in that the number of sleeves is at minimum one per bar.

5. An adjustable device according to claim 1 characterized in that the torsion spring includes a leaf spring.

6. An adjustable device according to claim 1 characterized in that reference marks are present on the first bar .

7. An adjustable device according to claim 1 characterized in that the upper jaw is slightly curved.

8. An adjustable device according to claim 1 characterized in that the bars are interconnected.

9. An adjustable device according to claim 1 characterized in that the lower jaw is narrower than the upper jaw.

10. An adjustable device according to claim 1 characterized in that the lower jaw is curved slightly downward.

11. An adjustable device according to claim 1 further including a shaft, wherein the spring includes a torsion spring surrounding the shaft, and each jaw is articulated around the shaft.

12. An adjustable device according to claim 1 wherein the second bar is non-parallel to the first bar such that, at a point along a longitudinal dimension of the second bar, a separation of the second bar from the first bar is 1.2 cm and, at another point along the longitudinal dimension of the second bar, a separation of the second bar from the first bar is 2.2 cm.

* * * * *